United States Patent [19]

Fischel

[11] Patent Number: 4,856,788

[45] Date of Patent: Aug. 15, 1989

[54] METHOD OF PLAYING A GAME OF ECONOMICS AND FINANCE

[76] Inventor: Mario Fischel, Jakob-Klar-Str. 5, 8000 Munich 40, Fed. Rep. of Germany

[21] Appl. No.: 89,536

[22] Filed: Aug. 26, 1987

[51] Int. Cl.[4] ..... A63F 3/00

[52] U.S. Cl. ..... 273/256

[58] Field of Search ..... 273/256, 278

[56] References Cited

U.S. PATENT DOCUMENTS

| | | | |
|---|---|---|---|
| 2,174,058 | 9/1939 | McGennis | 273/256 |
| 3,058,747 | 10/1962 | Nemetsky | 273/256 |
| 3,807,739 | 4/1974 | Henley et al. | 273/256 |
| 4,363,628 | 12/1982 | Kirkpatrick et al. | 273/256 |
| 4,452,457 | 6/1984 | Atieh et al. | 273/256 |

OTHER PUBLICATIONS

German Patent Application 24 18 266, published Oct. 30, 1975.

Francis Le Bihan and Marc Comberg, *Pratique de La Bourse* (1987), pp. VII–IX, 83–112.

Michael Kalron and Ronald Segal, *The Book of Business Money & Power*, pp. 48–49.

"Stock Market Specialist" (1982).

"Stocks & Bonds" (1978).

"Gold!" (1981).

"The Option Game Board" (1975, 1978, 1985).

"POLECONOMY , The Power Game".

"Der Weg Zum Haws" (1986).

"Strike It Rich".

"Your Money" (1985).

"The Bottom Line" (1986).

"Shark".

"Mine A Million Business Game" (1976, 1986).

"Das Borsenspiel" (The Stock Exchange Game).

*Primary Examiner*—Edward M. Coven

*Assistant Examiner*—Benjamin Layno

[57] ABSTRACT

A board game apparatus for simulating situations of economics and finance includes: (a) a game board defining a multiplicity of contiguous marked space playing positions defining a continuous closed track extending about the game board, each space playing position bearing indicia of instructions for play of the game; (b) a plurality of playing pieces representing each player; (c) die for determining how many space playing positions to move each playing piece; (d) simulated money of different denominations for use by the players of the game; (e) cards indicating ownership of assets for purchase and sale by players using the simulated money; and (f) cards on one face indicating an event having a potential economic effect on the game value of an asset held by a player, and, when turned over to the other face after the players have had an opportunity to act upon an expected economic effect of the event, revealing the actual game economic effect of the event. The indicia of instructions for play of the game on the game board includes one or more spaces instructing a player to consult the cards indicating an event having potential economic effect and includes one or more spaces permitting a player to buy and/or sell the cards indicating ownership of an asset. A method of playing the board game is also described.

7 Claims, 9 Drawing Sheets

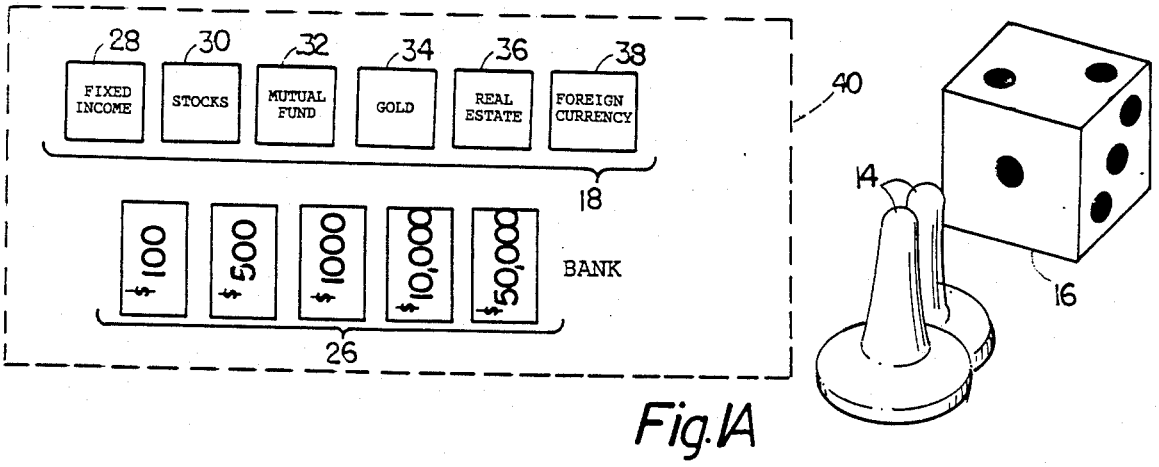
Fig.1A
Fig.1
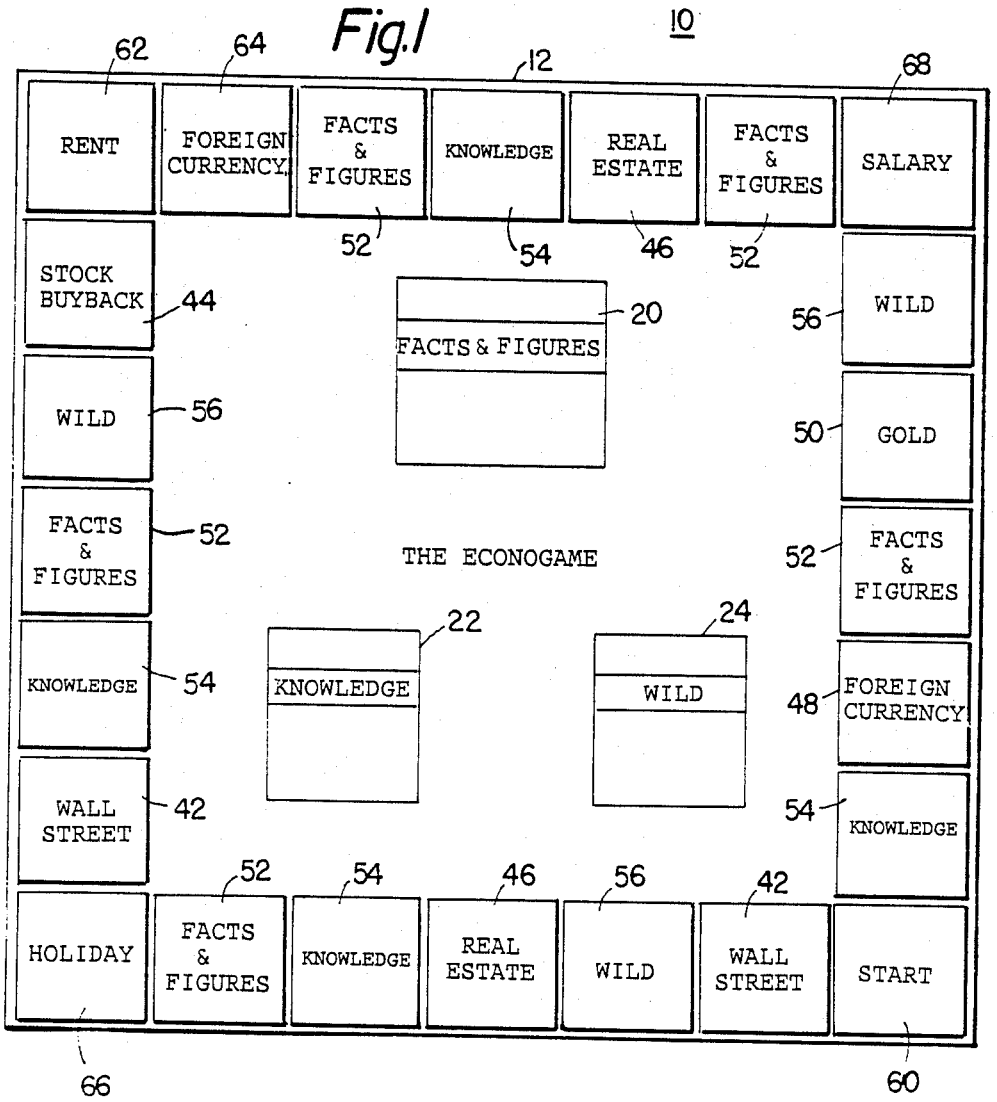

FACTS & FIGURES

Economists see a cyclical downturn in the economy looming.

Fig 2

Market Response :

Bad news for the stockmarket in general:

| | |
|---|---|
| **All U.S. stocks (except below) :** | **-$2,000** |
| **DOW JONES :** | **-$2,000** |
| **UNITED CHEMICALS :** | **-$3,000** |

(as a typical *cyclical* industry, chemicals are particularly sensitive to the business cycle)

| | |
|---|---|
| **ASSOCIATED CONTRACTORS:** | **+$1,000** |

(construction is *anti-cyclical*, because slow growth means low credit demand, and hence lower interest rates)

| | |
|---|---|
| **PHARMA :** | **+$0** |

(as a *growth stock*, it is not much affected by the business cycle)

| | |
|---|---|
| **ALLIED FOOD :** | **+$1,000** |

(food is a *defensive* industry, as people have to eat even during recessions : investors thus seek the stability of these companies in periods of economic trouble)

Fig 2A

KNOWLEDGE CARD

What is the name of the international organization whose role it is to promote *free trade* ?

(a) OECD
(b) IMF
(c) GATT
(d) BIS

Fig.3

Answer : c

GATT = General Agreement on Tariffs and Trade
Its objective is to eliminate all trade barriers (such as *tariffs*, *quotas*, *standard requirements*, etc. ) hampering the free flow of goods between the participating countries.

Fig.3A

WILD CARD

Fig.4

BONUS

Your company has made a record profit this year. Each employee gets a $2,500 bonus.

Collect $2,500 from the Bank.

Fig.4A

FIXED-INCOME

CERTIFICATES OF DEPOSIT
(CD)
$5,000

Yield : 7% ($350)
Maturity : 1 year
Liquidity : bad
Risk : excellent

Note : higher yield, but less liquid than MM accounts ; comparable to a savings account.

Fig. 5

STOCKS

'SECURITIES CORPORATION'
$10,000

Yield : 3% ($300)
Investment bank / broker.
Main lines of business :
- underwriting stock and bond issues
- broking, i.e. buying and selling securities on behalf of others
- trading in securities for its own account
- arranging mergers and acquisitions (M & A)

Fig. 6

MUTUAL FUNDS

'PENNY STOCK'
$1,000

This fund invests in up-start high-tech companies (bio-technology, data processing, new materials, aerospace, etc.).

None of these firms has yet achieved any breakthrough ; hence, no dividend distribution yet.

Fig. 7

GOLD

1 ounce of gold
$400

No yield

Fig. 8

REAL ESTATE

'HOME & OFFICE'
$5,000

Yield : 2% ($100)
Investment trust; buys and rents out (or re-sells) property, for personal or commercial uses.
Main locations in Texas and in the Midwest.
Note : an investment trust is similar to a mutual fund - the $5,000 investment trust unit represents in fact a share of a company investing in property.

Fig. 9

FOREIGN CURRENCY

DM - Deutsche Mark
(West Germany)
U.S.$10,000

Fig. 10

Professional Game :

Corporate bonds bear the interest-rate risk :

CURRENT VALUE =
$10,000 *
actual yield /
current yield

Fig. 11

Professional Game :
CURRENT VALUE :
Interest rate (i) :
8%-plus => -$2,000
6%-minus => +$2,000
BNYC is a *money-center bank* with few free deposits, and with many fixed-rate long-term loans outstanding. Hence, higher interest rates increase the bank's cost of borrowing funds, while the revenue from its fixed-rate assets remains constant. In addition, high interest rates increase the risk of debtor defaults.

Fig. 12

Professional Game

CURRENT VALUE :
Growth :
4%-plus => +$3,000
2%-minus => -$3,000
(strong growth boosts company sales and earnings)

Real interest rates (i-p) :
5%-plus => -$2,500
2%-minus => +$2,500
(low real interest rates stimulate economic growth, and make stocks more attractive than bonds)

Fig. 13

Professional Game :

CURRENT VALUE :
Inflation 5%-plus => + $100
DM/$ exchange rate :
2.10-plus => -$100
1.90-minus => +$100
Yen/$ exchange rate :
160-plus => -$100
140-minus => +$100
Gold is a hedge against inflation and a depreciation of the dollar against other currencies : both entail a loss of confidence in the dollar, which makes investors shift into gold.

Fig. 14

Professional Game :

CURRENT VALUE :
Inflation 6%-plus =>
+ $1,000

Similar to gold, real estate offers protection against a depreciation of $-denominated assets (inflation erodes the dollar's purchasing power, while *real assets* retain their value).

Fig. 15

Professional Game :

CURRENT VALUE :
The £-sterling used to be considered a petro-currency - i.e. a currency whose value is linked to the oil price because of Britain's important oil exports. However, this link is weaker now, as the markets have come to realize that manufactured goods plus services, and not oil, account for the bulk of british export earnings :
Oil :
$23-plus => +$500
$17-minus => -$500

Fig. 16

FACTS & FIGURES

The Fed (Federal Reserve Board) tightens *monetary policy*, for fear of inflation.

Fig. 17

Market Response :

Tighter money supply pushes up interest rates (there is hardly enough money suppply to satisfy demand).

Higher interest rates depress the entire stockmarket, because they stifle investment and growth, and because they make interest-bearing securities, such as bonds, relatively more attractive than stocks :

| | |
|---|---|
| **All U.S. stocks :** | **-$1,000** |
| **DOW JONES :** | **-$1,000** |

KEY INDICATORS :
Interest rate (i) : +2%
GDP growth (g) : -1%
Inflation rate (p) : -1%
(tighter money supply and slower growth ease inflationary pressures)

Fig. 17A

Fig. 17b

ECONOMIC POLICY

You may act on KEY ECONOMIC INDICATORS by adopting economic policy decisions !

Choose to increase or cut taxes:
- higher taxes stifle growth, but lead to lower interest rates (less borrowing needed to finance the budget deficit):
  g: -2% i: -2%
- lower taxes have the opposite effect:
  g: +2% i: +2%

CONTROL PANEL

Key Economic Indicators

Initial values :

Real GDP growth rate - g : 3%
Inflation rate - p : 4%
Nominal interest rate, 1-year Treasury bills - i : 8%
Crude oil price : 20 $/barrel
D-mark exchange rate : 1$ = 2.00 DM
Yen exchange rate : 1$ = 150 yen

| Growth (%) | Inflation (%) | Interest rate (%) | Oil ($/bl.) | DM (DM/$) | Yen (Yen/$) |
|---|---|---|---|---|---|
| 3 | 4 | 8 | 20 | 2.00 | 150 |

Fig. 18

METHOD OF PLAYING A GAME OF ECONOMICS AND FINANCE

This invention relates to games simulating the real-life world of economics and finance.

The idea of being able to understand the workings of financial markets, and using that knowledge to invest, e.g., in the stock market, real estate or precious metals, appeals to most everyone. However, to the public in general, the world of economics and finance is too fast moving, and the rules are far too complex to easily master or understand.

The objectives of this invention include providing a game that, at a beginner's level, can be played by persons of all ages and experience, and introduces the players to the rules of economics and finance in a manner that allows these rules to be mastered over time. The game, even at the beginner's level, closely reflects the real world experience, but at a reduced level of complexity that facilitates the learning process and allows the players to enjoy the game while learning. The game further provides advanced and professional levels of play for those that have mastered the beginner's level and wish to continue at levels of advanced complexity, even more closely approximating the real world of high finance.

SUMMARY OF THE INVENTION

According to the invention, a method of playing a board game simulating situations of economics and finance comprises: (a) each player, in turn, constituting an initial portfolio of assets by exchange of simulated money for means indicating ownership of assets; (b) each player, in turn, actuating the means for determining how many space playing positions to move his playing piece, and advancing his playing piece the determined number of positions along the closed track about the game board; (c) each player on landing his playing piece upon a first space consults the means for indicating an event having potential economic effect, acts as he considers appropriate to maximize the total of his simulated money and asset value by buying or selling assets or by taking no action, and thereafter consults the means for subsequently revealing the economic effect of the event, players thereafter receiving or paying simulated money on the basis of the economic effect of the event on the assets in their respective portfolios; (d) each player on landing his playing piece on a second space buys and/or sells assets or takes no action as he desires; and (e) play of the game continues with each player acting in turn until the value of all assets and simulated money held by one player exceeds a predetermined total and that player is declared the winner.

Preferred embodiments of the method include one or more of the following features. The assets comprise liquid and illiquid assets, and payments by a player are permitted in simulated money or liquid assets. The assests also comprise high risk and low risk assets. Acquisition and sale of assets is permitted between a player and a game bank, or, in another embodiment, also between players. Before consulting the means for subsequently revealing the economic effect of an event, a player is permitted to purchase options on one or more assets. The means for subsequently revealing the economic effect of an event includes indicia of changes in key economic indicators, and the value of assets held by players fluctuates during play of the game in response to these key economic indicators.

Thus there is provided an educational board type game designed to teach non-specialized players the basic laws of economics and finance through a simulation of real-life financial markets behavior. Players are endowed with starting capital and try to build it by investing in various types of securities and real assets, represented by asset cards. Asset characteristics in play, notably with regard to the main financial criteria of yield, liquidity and risk, are similar to the actual real life features of the corresponding assets. All major forms of investments are included, i.e., bank deposits, money-market accounts, bonds, mortgage backed securities, stocks, mutual funds, foreign currency denominated securities, gold, real estate, etc. The value of these assets change during play in response to FACTS AND FIGURES cards drawn by players when landing on specific space on the board. These cards contain, on their front side, news and events from different areas, such as the economy, financial markets, corporate reports, politics, society, technological developments, and deal framework. Players analyze these news events in view of all their possible economic implications, in particular their impact on the prices of the various assets available in the game, either through direct channels of influence or via such variables as interest rates, inflation, growth, exchange rates, etc. Players are given the opportunity to react according to their analysis of the situation and expectations of ensuing price movements. The FACTS AND FIGURES card under consideration is then turned over to reveal a concise explanation of the actual significance and implications of the given event, and to reveal the corresponding asset price changes which translate into monetary gains or losses for the players concerned. Other ways of earning or losing money in the game include: KNOWLEDGE cards featuring multiple-choice questions on economic, business, trade, stock-market, and other matters, with the correct reply spelled out on the back of the cards; WILD cards consisting of various types of imaginary events affecting players' financial fortunes; a START space triggering payment of interest and dividends to securities owners when they pass the space; and a RENT space obliging players to pay rent unless they own, e.g., a condominium card.

These and other features and advantages of the invention will be understood from the following description of the presently preferred embodiments, and from the claims.

BRIEF DESCRIPTION OF THE DRAWINGS

FIG. 1 is a plan view of a playing area with the game board apparatus arranged for play of the game of the invention;

FIG. 1*a* is a perspective view of playing markers and die;

FIGS. 2 and 2*a* are face and rear views of a representative FACTS & FIGURES card;

FIGS. 3 and 3*a* are face and rear views of a representative KNOWLEDGE card;

FIGS. 4 and 4*a* are face and rear views of a representative WILD card;

FIG. 5 is a face view of a representative FIXED INCOME SECURITY asset card;

FIG. 6 is a face and rear view of a representative STOCK asset card;

FIG. 7 is a face and rear view of a representative MUTUAL FUND asset card;

FIG. 8 is a face and rear view of a representative GOLD asset card;

FIG. 9 is a face and rear view of a representative REAL ESTATE asset card;

FIG. 10 is a face and rear view of a representative FOREIGN CURRENCY asset card;

FIGS. 11 through 16 are rear views of representative assets cards, respectively for FIXED INCOME SECURITY, STOCK, MUTUAL FUND, GOLD, REAL ESTATE and FOREIGN CURRENCY, for advanced levels of play;

FIGS. 17 and 17*a* are front and rear views, and FIG. 17*b* is a rear view, respectively of a representative specimen of alternate embodiments of FACTS & FIGURES and WILD cards, e.g., for use in the Professional game; and FIG. 18 is a plan view of a control panel.

DESCRIPTION OF THE PREFERRED EMBODIMENT

The objective of Econogame, the game of the invention, is to provide exciting family entertainment while at the same time teaching the fundamentals of finance and money-management to, e.g., children from age 10 up to grownups with no or little background in this field. The game, during its play, conveys essential knowledge on general economic laws crucial to correct anticipation of stock market behavior and hence to devising a successful investment strategy. Based on the broad principle of learning by playing, the game proposes a solution to the most common problems encountered by people attempting to learn, on their own, the foundations of economics and finance. The difficulty of the subject matter is probably the single most important obstacle to successful learning. It is also a major reason why so many laypersons are actually frightened by economic and financial topics, even though they do feel that a better understanding of these issues would be most useful for them, as investors, students, professionals or simply concerned citizens. This difficulty is linked to the inherent complexity of economic life, which consists of relationships of different kinds between a near infinite number of economic agents and variables. As each part of the system is linked to each other part in numerous ways, and as many of these inter-releationships are neither quantifiable nor stable, nor even well understood, it is essentially impossible for the human mind to fully grasp the entire picture. The daunting task for economics and finance teaching is then to simplify reality so as to build a comprehensible model of the economy and of financial markets, while still taking the fundamental and decisive laws and principles properly into account. Textbooks and the specialized press do not always offer a satisfactory answer to this problem: the former require an input in terms of time and intellectual effort which the majority of working people are not able, and children often not willing, to provide; the latter often presuppose a level of knowledge and familiarity with financial terms and concepts which most non-specialists do not possess.

In view of these difficulties, the game of the invention offers an easier and more effective learning process, because it has been designed so as to keep the basic rules of play simple and to increase the level of difficulty only gradually and at a pace each player is free to set for himself. In the Basic Level game, only the most essential concepts, expressions and laws are introduced. Each is explained in simple, non-specialized terms in the rules and on the playing cards. It is not necessary that players understand all the basic notions from the beginning they may start playing with the simplest and most common forms of investment, while avoiding taking risky positions. Later, as they watch other players' strategies and learn from the successes and failures of their own investment decisions, they may venture into more sophisticated or speculative instruments. The speed at which they want to progress is thus left to their own best judgment. For instance, a player who does not know what commercial paper or mutual funds are, or who has never considered investing in non-dollar denominated securities, might simply exclude these types of assets from his portfolio when playing for the first few times, and stick to the money-market accounts, certificates of deposit or stocks with which he is already familiar. Once he has played several games he will have observed which market events move, e.g., the Deutsche Mark or Pound Sterling exchange rates, and how investors in various sorts of mutual funds or commercial paper have fared, and will thus naturally be inclined to start investing himself in these instruments.

In a similar way, notions such as yield, liquidity and risk are taught through practical experience rather than by mere theoretical explanation; thus, players who do not have a clear understanding of these notions from the outset will progressively become familiar with them and learn their actual meaning, just by applying the very simple rules of play relevant to these items.

In the Advanced and Professional Level games, the level of difficulty is gradually increased, in a way which allows players to become thoroughly familiar and comfortable with the concepts and techniques introduced at each level before advancing to the next one.

The fun and excitement element in the game is aimed at making an otherwise rather unattractive subject matter palatable to children and others. The overwhelming importance of this aspect will be recognized by all high-school economics teachers. Economics and finance are often viewed as boring and uninteresting topics by pupils because mostly theoretical problems are addressed and highly sophisticated methods employed. This common perception is reflected in the popular description of economics as the dismal science.

The game of the invention, in contrast, introduces and explains only basic economic laws and relationships, in an easily understandable way, and the practical usefulness of such knowledge is stressed as it helps players to increase their wealth. The FACTS & FIGURES cards of the deck expose the most common forms of economic thinking and cover the major economic laws which are still relevant in today's markets; in addition, all facts and figures are in a way typical of economic developments in the 1980's, so that players become familiar with many of the key present-day issues and trends. As to the KNOWLEDGE cards, they contain data about basic facts of business life, world trade patterns, major commodities, large corporations, common financial expressions, etc. They mainly aim to facilitate the reading of the specialized press and publications, by providing the indispensable background knowledge. Finally, the inclusion of a luck element through WILD cards and various other spaces, and the packaging of the whole into a traditional-style family board game are designed to stress the fun along with the educational element, in a mixture that takes due account of the natural limits to children's concentration capacity.

In application of the learning by doing principle put forward by many training institutes and managements consultants, essential notions and investment strategy options are taught by practical experience rather than by theoretical explanation alone. This is aimed at providing players with a better and more intuitive understanding of the issues involved.

A case in point is the yield-liquidity-risk trade-off that lies at the heart of all real life investment decisions. This trade-off is embodied in the rules of play concerning purchase, payment of interest and dividends, sale, redemption and default of the various securities available. Thus, players learn out of their own experience, what might be called the hard way if real money were involved, that:

some amount of cash should be held by players to be able to benefit from speculation opportunities that may arise suddenly;

lack of liquidity may compel players to sell off part of their assets at give-away prices if unexpected expenses occur;

high-yield junk bonds are riskier than ordinary fixed-income securities, as the borrowing corporation may default on its debt obligations;

non-marketable or large minimum-amount assets can bring higher interest income, but may also mean that profitable speculation opportunities are missed for lack of liquidity;

stocks with a low dividend yield often have better prospects for capital gains;

gold is expensive to investors in terms of the forgone interest on the capital committed, but offers a degree of protection against inflation, large-scale debt defaults, a stock-market crash, etc., that is not available through financial assets.

Similarly, the working of options and futures contracts is best taught through actual experience with these types of instruments. In the same manner as for the yield-liquidity-risk trade-off, this also brins about a better understanding of the concepts of leverage and hedging.

Still in application of the same principle, the anticipation of responses to FACTS & FIGURES cards constitutes highly beneficial mental gymnastics, as it obliges players to scrutinize each new event or headline for all the possible consequences and knock on effects it might have, and to react quickly and adequately to the foreseen market response. Again, this is of the greatest practical usefulness to players, as successful portfolio management in today's volatile markets requires being quick to spot trend reversals and act accordingly. In addition, the educational value is incomparably greater than in ordinary games where players are simply confronted with good or bad news, without being required to analyze an event for all its possible implications.

Hence, the game's approach to economics and finance teaching at the introductory level represents a fundamental innovation in terms of educational techniques. The game is designed so as to make basic economic and financial knowledge accessible to large parts of the population, in a time-saving, effective and pleasant way. As such, it constitutes an important advance in pedagogic methodology, with large potential benefits in terms of general levels of education and productivity, and possibly with widespread applications in other areas.

RULES OF PLAY

The EconoGame can be played at 3 different levels:

(1) the Basic Game (2) the Advanced Game (3) the Professional Game

Newcomers to the world of economics and finance, including children, can play the Basic Game. When all players are thoroughly familiar and feel comfortable with the rules and concepts of the Basic Level Game, they can consider switching to the Advanced Level, usually after about 10 to 20 Basic Games have been played. It is recommended to consider only the simpler rules provided for the Basic Game until these rules have been understood and successfully put into practice. This avoids confusing beginners with the more complicated rules and strategy options of Advanced and Professional Games. The aim is to make the learning process as easy and pleasant as possible, by allowing time for familiarity with the most essential laws and notions before newer and more complex ones are introduced.

1. Equipment

Referring now to FIG. 1, the components of the game board apparatus are shown arranged for play on playing surface 10. The components consist of game board 12, pawns 14 of different colors (FIG. 1*a*), a die 16, a set of ASSET cards 18, a deck of FACTS & FIGURES cards 20 (FIGS. 2, 2*a*), a deck of KNOWLEDGE cards 22 (FIGS. 3, 3*a*), a deck of WILD cards 24 (FIGS. 4, 4*a*), and EconoMoney playing currency 26, e.g., in notes of $100, $500, $1,000, $10,000 and $50,000.

The ASSET cards 18 fall into six main categories:

FIXED-INCOME SECURITIES 28, (FIG. 5), e.g. bonds or certificates of deposit. They can be bought when landing on or passing Start (60), and pay out a fixed amount of interest the next time(s) the owner passes Start. Short-term fixed-income securities are paid off after one round, long-term securities only when the investor decides to sell them. Fixed income assets can be either liquid, i.e. sold anytime (except when landing on a Facts & Figures space), or illiquid, i.e. unsalable (the owner must wait until they are paid off).

STOCKS 30 (FIG. 6) (shares in American companies). Stocks have a $10,000 face value and pay out a dividend (usually 3%) when the stockholder passes Start. They can be bought when landing on a Wall Street or a Facts & Figures space, before the Facts & Figures Card is turned over. Stocks can be sold on Wall Street, Stock Buyback or Facts & Figures (again only before the back of the card is read). Stocks are more risky than fixed-income securities, as their value fluctuates in response to Facts & Figures.

MUTUAL FUNDS 32, (FIG. 7) (American or foreign). They are similar in all aspects to stocks (mutual funds represent investments in a range of stocks).

GOLD 34, (FIG. 8). Certificates of ownership over 1 ounce of gold (face value: $400) can be bought or sold on a Facts & Figures (before the card is turned over) or the Gold space.

REAL ESTATE 36, (FIG. 9) comes in form of condominiums or investment trusts specialized in property. Both are bought and sold on Facts & Figures before turning the card) or on Real Estate spaces.

FOREIGN EXCHANGE 38, (FIG. 10), (D-mark, Yen, Pound Sterling, Canadian $ or Australian $), can be bought/sold when landing on Facts & Figure (before turning the card) or on the Foreign Exchange space.

2. Getting Started

A BROKER is first selected among the players. The Broker handles all transactions among players and the BANK 40: purchases and sales of ASSETS 18, payment of interest and dividends, payments resulting from KNOWLEDGE and WILD cards, etc. No transactions between players are allowed in the Basic Game. The player most familiar with the Rules should be chosen as Broker.

Players throw one die each and the player with the highest throw begins.

Each player receives $100,000 in cash 28 from the Bank 40. The starting player selects a pawn 14 and constitutes an initial portfolio. He is free to allocate his money as he wishes among the various ASSETS available in the game; he may also keep whichever amount he likes in cash.

The other players then, in turn, moving in clockwise direction, choose a pawn, collect $100,000 and buy ASSETS 18. Assets can only be bought if the corresponding ASSET cards 18 are still available in the Bank 40. Thus, if a player wants to acquire a certain stock, but all cards have already been snapped up by his competitors, he must wait until one of them sells his holdings back to the Bank.

When all initial portfolios are constituted, FACTS & FIGURES, KNOWLEDGE and WILD card decks 20, 22, 24 are mixed and placed face up on their respective areas on the board. Pawns are placed on the START space 60 and the game begins with the player who had the highest initial die throw.

3. Moving on the Board

Players, in turn, move their pawns 14 around the board, in clockwise direction and by the number of spaces corresponding to their die throw.

Upon landing on WALL STREET 42, STOCK BUYBACK 44, REAL ESTATE 46, FOREIGN CURRENCY 48 or GOLD 50 space, a player moves a second time after his first turn is completed. A player may thus move several times in one turn.

Players keep their ASSET cards and cash money in front of them on the table. All players are free to consult other players' portfolios at any time.

When landing on a FACTS & FIGS. 52 or KNOWLEDGE 54 space, a player reads the front side of the card (e.g., FIGS. 2 and 3), which is on top of the respective stack (without yet removing the card from its stack). He then takes action as appropriate, turns around the card and reads out the text on the back (e.g., FIGS. 2*a* and 3*a*). He (and other players) generally pay or receive money. Finally, the player puts the card back, face up, at the bottom of its deck. The next FACTS & FIGURES or KNOWLEDGE card becomes thus visible to all players even before the next player lands on one of these spaces.

On a WILD space 56, a player draws the top card (e.g., FIGS. 4, 4*a*) from the WILD cards stack 24, turns it around and follows the instructions given on its back. He then puts it back on the bottom of the stack.

4. Investing in Assets

The main characteristics of the various types of ASSETS available in the game are described in here. They are also shown on the ASSET cards themselves.

Rules concerning buying and selling of assets, payment of dividends and interest, risk, etc. have been simplified over real life rules, but remain close enough to these so as to properly reflect the main trade-off that lies at the heart of any investment decision: namely between yield (return on capital, i.e. income derived from it), liquidity (ability to turn assets into cash money) and risk (possibility of decrease, or increase, in the value of assets). It is one of the primary goals of the same to gradually familiarize players with these basic notions, and help them develop a feel for the way they ought to be combined and weighted in order to achieve maximum financial well-being.

4.1 Fixed-Income Securities

FIXED-INCOME securities 28 are the first major category of assets. Generally speaking, they offer a stable return, as a fixed amount of interest is paid out each time the owner passes the START space 60, and bear little risk compared to STOCKS (see §4.2). In exchange, they offer less speculative zest, i.e., less hope for capital gains, than stocks.

Within the broad category of FIXED-INCOME assets, characteristics of specific types of instruments (money market accounts, certificates of deposit, Treasury-bills, corporate bonds, etc.) with regard to yield, liquidity and risk vary widely; however, they all share the fact that they represent plain and simple debt: money that an investor lends to an entity such as a bank, an industrial corporation or the Federal Government, and that must be paid back, in principal and interest. Hence, fixed income securities are fundamentally different in nature from stocks (equity), which represent ownership of part of a corporation.

All FIXED INCOME assets are characterized by:

(1) purchase: FIXED INCOME assets can be bought only when passing the START space. The purchase price is the face value, printed on the ASSET card.

(2) minimum amount: this is the face value of the ASSET card. It may be $5,000, $10,000, $25,000 etc. Generally, the larger the amount of money committed, the higher the interest rate paid out.

(3) yield or interest rate: interest is paid out by the Bank to the player holding a FIXED-INCOME ASSET when he reaches or passes the START space 60. The rate of interest is printed on the ASSET card. It is fixed in the Basic Game, i.e., it remains unchanged throughout the game. A bond with a $10,000 face value and a 9% interest rate for instance pays $900 ($10,000*0.09) whenever START is passed.

(4) maturity: a distinction between short-term and long term debt is made. Short-term paper has a maturity of 1 year in the game, corresponding to one complete rotation around the board: it is always bought on START (when landing on or passing by the space), and paid off (principal and interest) the next time the player passes START. Of course, the player can always opt to re purchase the asset immediately: he then collects interest only, and keeps his ASSET card.

Long-term paper in the game is treated as perpetual, i.e., never paid off by itself; but since all long-term fixed income securities in the game are liquid (see §5 below), they may in practice be sold anytime: hence, players may sell them when passing START, as though they were short term assets.

(5) liquidity: the general rule is that liquidity is good for so called marketable securities (e.g., Treasury-bills), which can be sold anytime, and bad for non-marketable securities (e.g., $5,000 certificates of deposit), which cannot be sold and must be held until redemption (i.e., until maturity, when the money is paid back). There are however two important exceptions to this rule: (a) all ASSETS, including illiquid debt securities, can be sold at any moment for half their face value, in the DISTRESS SALE procedure. (b) *no* ASSETS, except for cash money and the equivalent money-market accounts, can be used for speculation on FACTS & FIGURES cards (see section 5 below). That is, if a player wants to buy stocks upon drawing a FACTS & FIGURES card, he must pay for it in cash or money-market account, before the card is turned over. If he wants to sell other assets (e.g., stocks, or marketable fixed-income securities) before the Market Response, he may do so, but cannot immediately use the proceeds of the sale to buy assets. The same cash requirement applies to payments resulting from price declines in assets owned by players (see section 5): if the Market Response to a FACTS & FIGURES is a $2,000 price-fall for a certain stock, then all players holding this stock must pay $2,000 per share to the Bank, out of their cash holdings or money-market account balances. No other assets, including marketable fixed-income securities, can be used for this purpose.

This is the very important CASH MANAGEMENT PRINCIPLE in the game. It is based on the yield-liquidity trade-off: cash earns no interest, but players should always hold some of it for speculative purposes or for unforeseen expenses. As to money-market accounts, they offer in a way the best of both worlds, since they are virtually as liquid as cash, but still pay out interest; however, the number of corresponding asset cards in the game is limited.

(6) risk: basically, FIXED INCOME assets are low risk assets when compared to stocks, mutual funds, gold, etc. However, credit risk, or risk of default of the borrower, does exist in the Basic Game. This risk is excluded for loans to banks (e.g., money-market accounts or certificates of deposit) or to the Government (e.g., Treasury-bills); it only exists for loans to private companies (e.g., corporate bonds). In fact, it mainly arises in connection with so called junk bonds, which pay a higher interest rate than other assets, but become worthless when a WILD card signaling default is drawn (this is the yield risk trade-off).

4.2 Stocks and Mutual Funds

STOCKS and MUTUAL FUNDS are the other major type of investment. They offer the best opportunity to turn a player's understanding of economics and feeling for markets into hard dollars.

Stocks represent U.S. companies only, while mutual funds may consist of U.S. or foreign stocks. Stocks and mutual funds are treated as identical in the game; they will be referred to as stocks throughout the Rules. The main features of this type of assets are:

(1) purchase: stocks can be bought at face value on three occasions: at the beginning of the game (initial portfolio constitution); when landing on a WALL STREET space 42; when drawing a FACTS & FIGURES card, before the Market Response (i.e., before the back of the card is consulted).

(2) face value: is always $10,000 (except for penny stocks, which have a face value of $1,000).

(3) description: the front side of the ASSET card 30 features the NAME of the company or mutual fund and a brief description of its main activities. (All companies in this game are fictitious: they merely serve the purpose of showing how the prices of stocks rise or fall in response to specific events.)

The backs of the asset cards are not relevant in the Basic Game and should be ignored.

(4) yield: unless otherwise stated on the asset card, all stocks and mutual funds pay out a 3% dividend when passing START 60 (i.e., stockholders receive $300 from the Bank, for each share with a $10,000 face value).

(5) sale—liquidity: stocks can be sold at face value on a WALL STREET space 42, a STOCK BUYBACK space 44 or a FACTS & FIGURES space 52, before the Market Response. In accordance with the CASH MANAGEMENT PRINCIPLE, the proceeds of a stock sale cannot be used for speculation on a FACTS & FIGURES card, i.e., the money cannot be used in that move to purchase other assets: these purchase have to be financed out of either cash balances or money-market accounts.

Like all other assets, stocks can be sold anytime for half face value in the DISTRESS SALE procedure.

(6) risk: stocks are inherently risky investments, as their prices change in response to FACTS & FIGURES. However, by learning how to react to these news, and by achieving a careful balance in a portfolio, it is possible to progressively enhance yield and capital gains while still getting some downside protection.

4.3 Other Assets

The other types of assets available in the game are: GOLD 34, REAL ESTATE 30 and FOREIGN CURRENCIES 38. The rules for purchase and sale of these assets are identical to those for stocks and mutual funds, except that the WALL STREET space 42 is replaced with, respectively: the GOLD space 50, the REAL ESTATE space 46, the FOREIGN CURRENCY space 48.

GOLD is represented by certificates of ownership over 1 ounce of gold (FIGS. 8, 8*a*). The price (face value) is set at $400 in the Basic Game. The yield is nil, as gold pays out neither interest nor dividend: you thus forego these sources of income by investing in gold.

REAL ESTATE comes in form of:

condominiums (first installment—face value: $10,000), which yield no income but save their owner the payment of rent when landing on the RENT space 62; and shares of investment trusts investing in residential or commercial property (face value: $5,000), which pay a 2% (i.e., $100) dividend out of their rental income when passing START.

GOLD and REAL ESTATE are regarded as real assets, as opposed to stocks or bonds which are paper assets. Gold and real estate thus bring in little or no income, but offer valuable protection against the threats of, e.g., a major financial crisis, a stock-market slump or runaway inflation.

FOREIGN CURRENCY is traded in form of currency account deposits with a face value of U.S. $10,000. No interest is paid out by foreign currency holdings in the Basic Game. The following currencies are available: Deutsche Mark (West Germany), Yen (Japan), Pound Sterling (United Kingdom), Canadian dollar, and Australian dollar.

The prices of GOLD, REAL ESTATE and FOREIGN CURRENCY fluctuate in response to FACTS & FIGURES just as stock and mutual fund prices do. Similarly, players may speculate on price movements of these assets in the same way as for stocks or mutual funds (see section 5 below).

5. Facts and Figures

The different ways to play a FACTS & FIGURES card are explained here through a series of examples. The face of the card (FIG. 2 describes a single event; on the reverse side, revealed only after a player has acted upon his expectation of the effect of the event on stock or other assets, the actual effect is shown and explained in detail. The impact of the event on all existing companies, assets, key economic indicators, etc., in the game is taken into account, and the impact of the event closely reflects real-life financial markets behavior. Ordinarily, a FACTS & FIGURES card will alter the price of one or several ASSETS, notably stocks: this translates into money being paid out by the BANK to all stockholders in case of a price rise, and into money being paid by all stockholders to the BANK in case of a price fall. The face value of an asset remains unchanged throughout the game. Thus, if, for example, the Market Response to a given FACTS & FIGURES card (as indicated on the back of the card) is a $2,000 rise in 'Business Corporation' shares, then all players holding this stock receive $2,000 per share from the Bank, while the face value of Business Corp. shares remains at $10,000.

For the acting player (the one who draws the FACTS & FIGURES card), five different combinations of market position and expectations are possible for any given type of asset, according to whether he already owns it or not, and according to whether he thinks its price will go up, down or remain flat. Consider as an example the 'Business Corp.' stock:

(1) the player may think that the stock price will not change in response to a given FACTS & FIGURES: he then simply takes no action on it (whether he owns it already or not);

(2) suppose now that the player owns 1 Business Corp. share (face value: $10,000), and is bullish on this stock, i.e. expects a price rise in response to the given FACTS & FIGURES: he keeps his share, turns around the FACTS & FIGURES card and reads out the Market Response. If this indicates say a $1,500 rise in Business Corp., then all players holding the stock collect $1,500 per share from the Bank. If the Market Response is a $3,000 price decline, all stockholders must pay $3,000 per share to the Bank. If they do not have enough cash or money market accounts to meet these obligations (other assets, even marketable fixed income ones, cannot be used for this purpose), they have no choice but to sell one or several of their assets for half face value to the Bank in order to raise cash (this is the DISTRESS SALE, i.e., a sale for half price, of some of his assets; however, this is not generally a commendable solution);

(3) the player may also be bullish and not yet own any shares of Business Corp. He then buys stock from the Bank. This is subject to two conditions: the corresponding ASSET cards must be available in the Bank, and the player must be able to pay for his purchase in cash or in money-market accounts. As explained above, he may not use any other assets for this purpose. While all assets, except for non-marketable fixed-income securities, can be sold upon drawing a FACTS & FIGURES card (before the Market Response , the proceeds of such sales may not be used to pay for purchase of other assets. Of course, a player can always raise cash through a DISTRESS SALE, i.e., a sale for half price, of some of his assets; however, this is not generally a commendable solution;

(4) the player may own the stock and be bearish on it, i.e., expect a price decline: he then sells his shares before the Market Response, and thus avoids any payments resulting from possible price declines; and (5) finally, the player may not presently own the stock and be bearish on it. He takes no action and sits back to watch his competitors lose their shirts.

In the Advanced Game, more sophisticated instruments, such as options or direct exchanges between players, are available.

NOTE The impact of FACTS & FIGURES on stock quotations, old and real estate prices, exchange rates, etc. is designed so as to reflect as closely as possible real life financial market behavior. However, players must be aware that actual market responses may sometimes differ from those indicated in the game, because:

real life situations are always more complex than the simulated events in the game: while the latter focuses on only one significant piece of news and attempts to rasp its implications, real investors react to whole sets of inter-related and more or less important information; and while the purpose of the game is to show the economic logic underlying market moves and reactions, actual market behavior sometimes follows apparently irrational patterns, which cannot be explained by means of traditional economic thinking (as applied in the game).

6. Knowledge

A KNOWLEDGE card features a multiple choice question on the front side (FIG. 3) and the correct answer(s), along with explanations, on the back (FIG. 3*a*). Questions concern all aspects of economic, financial and business life. Usually there is only one correct answer; however, other combinations, such as several or no correct answers, are possible. A reply is considered correct only when the exact combination of right answers has been selected (for instance, if a player answers b, while b and c are correct, he is considered to be wrong). The reference year for all replies is 1987.

A player drawing a KNOWLEDGE card can choose to bet either $500 or $2,000. He doubles or loses his stake, according to whether he picks the right answer(s). The $500 or $2,000 stake must be put up in cash money market accounts or marketable fixed-income securities.

7. Wild Cards

WILD cards contain, on the back (FIG. 4*a*), instructions to players. They usually mean good or bad luck for the drawing player.

Penalty payments resulting from WILD cards must be met out of cash, money-market accounts or marketable fixed-income securities. Hence, rules in this respect are similar to those for KNOWLEDGE card stakes, and different from those prevailing for asset purchases or price declines related to FACTS & FIGURES. (In the latter cases, only cash or money-market accounts can be used.)

In case WILD card penalty payments cannot be met out of cash, money-market accounts or marketable debt securities, other assets must be sold in DISTRESS for half their face value.

8. Other Spaces

WALL STREET (42): you may buy or sell STOCKS 30 or MUTUAL FUNDS 32 to or from the Bank. The net purchase price (i.e., the price of the stocks or mutual funds you buy minus the price of those you sell) must be paid in cash, money market accounts or marketable securities.

STOCK BUYBACK (44): you may sell to the Bank for face value one of your stocks or mutual funds. Only one type of stock may be sold, and you must sell all of your holdings in that stock.

REAL ESTATE (46): similar to WALL STREET, but for assets related to real estate, i.e., condominiums and property investment trusts.

GOLD (50): similar to WALL STREET or REAL ESTATE, for gold.

FOREIGN CURRENCY (64): similar to WALL STREET, for foreign currency.

START (60): you collect dividends and interest on all fixed income assets, stocks, mutual funds and investment trusts in your portfolio when landing on or passing this space. At the same occasion, all short term fixed-income assets are redeemed, i.e., paid off by the Bank, and you may purchase new fixed income assets.

RENT (62): pay $1,500 to the Bank. Do not pay if you hold a condominium card.

HOLIDAY (66): take a 2-week vacation: pay $1,000 for travel and hotel expenses and skip your next turn.

Both RENT and HOLIDAY payments must be met out of either cash, money-market accounts or marketable fixed-income securities.

SALARY (68): collect $2,000 from the Bank.

Note: Rules concerning spaces are usually valid only when a player lands on a space. The only exception is the START space, which is effective for players landing on or passing it.

9. Glossary

Definitions of economic and financial terms may be provided in a Glossary.

10. Cheating

Any player found cheating, i.e., by reading the back of a FACTS & FIGURES or KNOWLEDGE card without being authorized to do so, must pay a $5,000 penalty to the Bank (only cash or money market accounts).

11. End of Game Winner

The Winner is the first player whose total CAPITAL, i.e., the value of all his assets including cash, is $200,000.

The Winner retires from the game and returns his asset cards and money to the Bank. If there are three or more remaining players, the game may continue, if the players wish so, until the first runner-up is made out (again, by having a CAPITAL of at least $200,000). At that time, the game ends and the remaining players are ranked according to the value of their portfolio.

12. Refills

Sets of additional playing cards may be made available to the public, incorporating the latest developments in the U.S. and world economy, as well as focusing on specific areas of particular interest to investors.

The game of the invention may also be played using Advanced or Professional rules.

ADVANCED GAME RULES

The Advanced Game is similar in idea and structure to the Basic Game, but includes two additional features that allow knowledgeable players to develop more elaborate strategies:

(1) Direct exchanges between players, through the Asset Bidding procedure, are made possible.

(2) Options can be purchased from the Bank.

1. Asset Bidding

In the Basic Game, no transactions between players are allowed. In the Advanced Game, there is one exception to that rule: the ASSET BIDDING procedure.

When a FACTS & FIGURES card alters the value of an asset, all players holding that type of asset in their portfolio are concerned. Under the Advanced Rules, a player can protect himself against a price decline resulting from a FACTS & FIGURES card drawn by another player. In the Basic Game, a player had no possibility to avoid losses, even if he correctly anticipated the price decline. In the Advanced Game, if he is bearish, a first player may offer his assets to a second player for any price he considers acceptable. The second player then faces the choice either to decline or to accept the offer. No counter-proposals can be made, i.e., the bargaining is limited to one round. If the second player accepts the offer, he pays in cash or money market accounts and the ASSET cards are exchanged. The whole bidding and exchange process takes place before the Market Response.

If the asset's face value is $10,000 and the first player expects a $2,000 price fall, he may offer the asset in question e.g. for $9,000. If the price he asks is too low, he may lose as much or more as by simply holding on to his assets; if it is too high, the second player is likely to decline his offer. He, in fact, will probably accept the offer if he himself is bullish or neutral on the given asset. But even if he shares the first player's bearish outlook, he might go along with the deal: he can easily protect his position by selling the newly acquired assets before the Market Response, or even by buying put options on them (see section 2 below).

In a similar way, the drawing player may bid for assets held by another player, if he is bullish on them, but they are no loner available in the Bank. This is in effect an alternative to buying call options on those assets as described below. Usually, the second player will accept the proposal if he is not so bullish on this asset, or if the price seems attractive to him. The procedure is identical to the one described above.

2. Options

A simplified version of OPTIONS is introduced in the Advanced Game, with the objective of broadening the scope for speculation and to familiarize players with the concept and working of options. These "mental gymnastics" are an essential prerequisite for the successful use of options in real-life portfolio management.

The characteristics of OPTIONS in the Advanced Game are as follows:

(1) options can be bought by players whenever they draw a FACTS & FIGURES card, before seeing the Market Response. At that time, the player who drew the card may buy up to 20 options from the Bank.

(2) options are either call or put options. A call option allows its owner, at his discretion, to acquire the asset in question at a pre-set price, called the strike price, before a specified date (called the expiry date). A put option allows the owner to sell the asset concerned.

(3) only one class of options (either call or put), on only one type of asset, can be bought at a time.

(4) options are available for all stocks and mutual funds (except PENNY STOCKS), for foreign exchange deposits and for old. The Bank must always sell the required options.

(5) options must be paid for in cash or money-market accounts. Other assets, including marketable debt securities, cannot be cashed in for that purpose.

(6) the price of an option (the premium) is $500 for all stocks and mutual funds, $20 for an ounce of gold and $500 for a foreign currency account. No option cards exist in the game. The purchase of options is sealed by a verbal agreement between the player and the Broker (and by the player coming up with the cash).

(7) the strike price is always face value (excluding possible price rises or falls in response to FACTS & FIGURES). Options expire after the Market Response, when the turn passes to the next player.

(8) if an option is exercised, i.e., if the assets in question are bought (in case of a call option) or sold (put option) by the player, he may immediately close out his position, by selling the assets he just bought, respectively, buying those he is about to sell. In both cases, the offsetting transaction takes place at the price prevailing after the Market Response, i.e., face value plus or minus the market response. Note that, usually, sales and purchases of assets are not permitted after the Market Response: this is the only exception.

(9) no options may be written, i.e., sold, by players in the Advanced Game.

Illustration

Consider a mutual fund investing in a broad spectrum of U.S. stocks, so as to reflect the overall evolution of the stock market. The face value is $10,000. Player One, who does not yet own any share in that mutual fund, now draws a FACTS & FIGURES card that makes him feel bullish about that particular mutual fund. He then has several possibilities to speculate. The simplest one (and the only one available in the Basic Game) is to buy shares of the mutual fund from the Bank (say one share for $10,000). But, if the cards are no longer available in the Bank, or if Player One is willing to take larger risks, he may also buy CALL OPTIONS on the mutual fund in question from the Bank. If he invests the same amount, i.e., $10,000, he gets twenty options (20 * $500=$10,000). These allow him, if and only if he desires so, to acquire 20 shares of the mutual fund from the Bank after the Market Response. for the price prevailing before the Market Response ($10,000 per share in this case).

Let's examine now what may happen, according to the actual Market Response:

(1) Player One is right and the shares rise by say $2,500. If he had simply bought one share, he would keep his share and collect $2,500 from the Bank. If, however, he had bought twenty call options, he would now in all likelihood exercise the options: i.e., buy 20 shares for $10,000 each. Normally he would then immediately re-sell these shares: in that case, the corresponding asset cards do not have to be available in the Bank, nor must the Bank come up with 20* $10,000=$200,000 in cash. He simply collects the difference between the sales and the purchase price, i.e., the price rise implied by the Market Response on the FACTS & FIGURES card, multiplied by the number of shares: 20* $2,500=$50,000. Since he has paid 20* $500=$10,000 for the options, his net profit is $50,000 −$10,000=$40,000. This is 16 times as much as he would have earned through an ordinary share purchase ($2,500).

Of course, Player One can also decide to keep the 20 shares bought through the exercise of his call options. In that case, the asset cards must be available in the Bank and he must pay the purchase price in cash (or money-market accounts). He may also decide to buy less than 20 shares (e.g., buy three shares or sixteen shares). In any case, he is eligible to receive the $2,5000 price rise for each share he acquires; this is deducted from the overall purchase bill.

(2) The share price is not affected by the Market Response. Player One neither wins nor loses anything if he bought plain shares, but loses the entire options premium (the purchase price of the options) if he bought options. He could, of course, exercise the options, but would have to pay the same price for the shares as if he had bought them in the normal way: whether he exercises or not, the options become in fact worthless.

(3) The shares fall, e.g., by $2,000. Player One loses $2,000 if he bought the share. If he bought options, he will not exercise them (as this would mean buying shares worth $8,000 for $10,000. He thus loses the entire $10,000 options premium.

It now becomes clear why options are a more leveraged form of investment: they usually offer a much higher reward than straight stock purchases if the investor's expectations materialize, but are also more risky as the entire options purchase price (the premium) is lost if the market moves the other way, or does not move at all. Note, however, that the risk is limited to the options premium, as options avail the buyer the opportunity to effect a transaction without compelling him to do so.

Let's consider now the case of Player Two, who is bearish on the given mutual fund, for a given FACTS & FIGURES card he draws. If she does not own shares in the mutual fund, she can speculate on a price decline by buying a PUT OPTION for $500 (in the Basic Game, there was no possibility to speculate, and make money, on falling markets). If the share price indeed falls, by $1,500 for instance, Player Two earns $1,500, as she is able to sell a share for $10,000 while buying it at the same time in the market for $8,500. Having spent $500 in option premium, her net gain is $1,000. If, however, the share price stays put or goes up, Player Two loses his $500 initial investment.

Imagine that Player Two already owns one share in the mutual fund when drawing the FACTS & FIGURES card. She may simply sell her share before the Market Response, or else buy a put option as a sort of insurance against a price decline. If the share price is down by say $2,000, she loses nothing if she has sold the share; if she has bought a put option instead, she will exercise, i.e., sell her share for $10,000: she again loses nothing, except for the option premium ($500). Thus, she is slightly better off with the straight share sale, but is protected against heavy losses in both cases. If the shares, however, rise by $2,000, Player Two will, of course, not exercise the option: she then loses the $500 premium, but earns $2,000 for the share she has kept. Thus, buying put options against existing holdings is a good solution in case of both price rises and declines; if prices however remain stable, the options become worthless and the premium is a straight loss.

Note: OPTIONS can, if skillfully used, enhance the performance of one's portfolio. However, they are not strictly speaking necessary to the game, even at the Advanced level: it may well be that a successful investor will never use an option.

3. End of Game—Winner

In the Advanced Game, the minimum CAPITAL required to win the game is raised to $500,000. This is because the use of OPTIONS considerably enhances the potential gains from successful speculation.

PROFESSIONAL GAME RULES

The main additional feature of the Professional Game is that Current Value of assets fluctuates in line with Key Economic Indicators, instead of being fixed at Face Value as in the Basic and Advanced level Games.

Concurrently, new ASSET, FACTS & FIGURES and WILD cards ar introduced.

1. New Asset, Facts & Figures and Wild Cards

The new cards are mostly related to Current Value, which did not exist at the Basic and Advanced levels. Many aspects deemed too complicated for beginners are thus taken into account more accurately in the Professional Game.

All ASSET cards (FIGS. 11–16) and most FACTS & FIGURES cards (FIGS. 17 and 17*a*) are in replacement of similar but more simplified versions used at the levels previously described; hence, these Basic and Advanced Game-only cards should now be taken out of the game and replaced with the new Professional Game cards. (Only a fraction of the Basic and Advanced Game FACTS & FIGURES cards become obsolete in this way; most cards are kept for all levels of play.) A few entirely new FACTS & FIGURES cards, as well as the Professional Game WILD cards, are simply added to the existing decks of cards.

The new ASSET cards are Fixed-Income Securities and Foreign Currency Government Notes. The former differ from the previous Fixed-Income assets in that the yield depends on current interest rates now (see §2.4 below). The latter are similar to the Foreign Currency accounts of the Basic and Advanced Games, but pay out interest to their holders. The rate of interest is variable and depends on current U.S. interest rates, printed on the Asset Cards, e.g., i+2% for Australian dollar notes, where i is the current level of American interest rates as shown on the Control Panel of the economy. Foreign currency government notes share the maturity, liquidity and risk characteristics of short-term U.S. government bonds (Treasury bills); however, they are also subject to currency risks. Unlike Treasury bonds, principal and interest payments fall due, not when the START space is passed, but when the space where the bonds were bought is passed; this may be either a FOREIGN CURRENCY or a FACTS & FIGURES space. Thus, the BROKER must note, on a separate sheet, which player bought Foreign Currency notes and on what space. If the notes are sold before the relevant space is passed, the interest is lost.

The new WILD cards allow players to take Economic Policy decisions on behalf of governments. These decisions alter the value of one or several Key Economic Indicators.

2. Key Economic Indicators and Current Value

In the Basic and Advanced Games, the value of assets was affected only by the market responses to FACTS & FIGURES cards, and occasionally by WILD cards. in the Professional Game, there is another way in which asset prices change through KEY ECONOMIC INDICATORS.

Key indicators are a set of fundamental figures reflecting the current status of the economy: inflation, interest rates, GDP growth, exchange rates, etc. Throughout the game, these indicators change in line with the business cycle and macro economic conditions. This happens through FACTS & FIGURES cards, which may alter the value of one or several indicators, just as they alter the value of various types of assets, or through WILD cards enabling players to take Economic Policy decisions.

Key indicators, in turn, determine the current value of several types of assets, in a way spelled out on the back of the corresponding ASSET cards. This concept of CURRENT VALUE is new and specific to the Professional Game (in the Basic and Advanced Games, the sales or purchase price of assets was always equal to their face value). In the Professional Game, assets are bought and sold at Current Value, which fluctuates in line with Key Economic Indicators.

Generally speaking, changes in current value reflect long-term evolutions, while FACTS & FIGURES-induced price changes can be viewed as short-term fluctuations in response to specific news. This is why a FACTS & FIGURE Market Response does not alter the underlying value of the asset (face value in the Basic and Advanced Game, current value in the Professional Game): it merely brings instantaneous gains or losses to its owners.

To illustrate, consider a mutual fund investing in a broad spectrum of U.S. stocks, so as to reflect the overall evolution of the stock market. The face value is $10,000. FACTS & FIGURES such as corporate reports, politicians' statements, tax changes, etc. will affect the value of the mutual fund. However, the game treats these price changes as temporary phenomenons: if the Market Response is for instance a $2,000 price rise, then all players owning shares in the mutual fund will receive $2,000 per share, but the current value of the shares will remain unchanged. In contrast, the game considers that there are two main factors which exert an overwhelming and permanent influence on the mutual fund's value: the rate of growth in the economy (strong growth boosts sales, earnings, and hence stock prices) and the level of interest rates (high real interest rates impose a drag on all economic activity, in particular capital spending, housing and automobiles; at the same time, they make interest-bearing forms of investment, such as bonds, relatively more attractive than stocks). These essential relationships are explained on the back of the mutual fund's ASSET card, along with the rules for CURRENT VALUE determination: these might say, for instance, that when GDP growth exceeds 4% per year in real terms, the current value increases by $2,000 (i.e., to $12,000), and that it decreases by $2,000 (to $8,000) if GDP growth is less than 1% a year. Similarly, the rules may indicate that real interest rates (i.e., nominal rates minus inflation) of 6%-plus (i.e., 6% or more) bring about a $1,000 price fall, while rates of 2%-minus (i.e., 2% or less) entail a $1,500 price rise. Both GDP growth and interest rates figure among the KEY ECONOMIC INDICATORS.

The standard procedure is then as follows:

(1) shares of the mutual fund are always bought at CURRENT VALUE (in the beginning, this is equal to face value). At the moment of purchase, the back of the asset card is consulted and current value ascertained.

Players try to memorize which indicators influence current value, and in what way.

(2) key indicators change continuously, as a result of FACTS & FIGURES and WILD cards. These changes are recorded by one player (see below), so that the present value of all indicators is always known to all players.

(3) when economic conditions, i.e. KEY INDICATORS, are favorable, players may want to sell their shares in the mutual fund. When a sales decision is taken, the asset card is again turned around and current value (i.e., the sales price) determined. Apart from these occasions, the back of asset cards may not be consulted during the game.

The detailed rules concerning KEY ECONOMIC INDICATORS and CURRENT VALUE of assets are as follows (only changes or additions to Advanced Game Rules are presented):

2.1 In the beginning, players select one ECONOMIST along with the BROKER among themselves. The ECONOMIST is in charge of the CONTROL PANEL of the economy: this is a sheet of paper showing the current value of seven key economic indicators. The initial values of those indicators figure on the control panel forms (FIG. 18) provided with the game (see §2.2). These initial values are purely fictitious; however, they do correspond to an overall economic situation that might well come up sometimes in the coming years.

The ECONOMIST's task is to keep track of all changes in KEY ECONOMIC INDICATORS: whenever such a change occurs, he strikes out the old value and writes down the new one below it, in the appropriate column on the CONTROL PANEL.

2.2 The KEY ECONOMIC INDICATORS, and their initial values, are:

GDP growth rate, real (g): 3%
inflation rate (p): 4%
interest rate, nominal, 1-year Treasury bills (i): 8%
crude oil price: 20 $/barrel
exchange rate Deutsche Mark: 1 U.S. $=2.00 DM
exchange rate Japanese Yen: 1 U.S. $=150 yen 2.3 The Current Value rules are spelled out on the back of all concerned ASSET cards. A typical example would be:

Real interest rate (i-p):
5%-plus=>−$3,000
1% minus=>+$2,000

This means that if the real interest rate (nominal interest rate minus inflation) equals 5% or more, the Current Value of the asset in question decreases by $3,000, while a real interest rate of 1% or less entails a $2,000 price rise.

2.4 The yield of FIXED-INCOME assets is now calculated based on the current value of the interest rate (i), as shown on the CONTROL PANEL. In the Basic Game, the interest rate was always equal to 7%.

The simplest case is that of short-term fixed-income assets: there, interest payments are evaluated using the interest rate prevailing at the moment when they fall due. With other words, the value of i at the moment when the player passes START and is due to collect interest, is taken into account.

As to long-term fixed income assets (e.g., bonds), the rate of interest prevailing at the moment of purchase is taken into account: that is, the same interest payments are made each year, regardless of what happens to current interest rates. E.g., for Foreign Currency, the BROKER has to record, on a separate piece of paper, which player bought fixed-rate long-term paper and at what interest rate.

2.5 Unlike other short term fixed-income assets, which trade always at face value (i.e., their current value always equals their face value), the CURRENT VALUE of long-term fixed-income assets fluctuates in line with interest rates. To understand this, consider an investor who has bought a $10,000 corporate bond with a fixed i+2% interest rate when i was 7%. He collects: 7+2=9% * $10,000=$600 in interest. He would thus be willing to pay a premium over face value for the bond serving 9% interest. The actual level of this premium would depend, among other things, on the remaining time until maturity. In the EconoGame, the simplified rule applied is as follows: the ratio of the actual interest rate of the asset in question (9% in this example) to the rate the same asset would yield if bought today (6%) is calculated; the resultant number (9/6=1.5) is then multiplied by the face value ($10,000 to obtain the CURRENT VALUE of the asset: 9/6*$10,000=$15,000. Current values are rounded to the nearest multiple of $10.

Thus, for long term fixed income assets, the interest rate i is the KEY ECONOMIC INDICATOR affecting CURRENT VALUE.

2.6 Stocks (and mutual funds) are always bought and sold at CURRENT VALUE. At the beginning of the game, current value equals face value (i.e., $10,000 for all stocks and mutual funds except penny stocks).

Now all assets are sensitive to KEY ECONOMIC INDICATORS. For those that are not, current value always equals face value. Whether assets are affected by indicators, why and in what way, is indicated on the back of the ASSET cards. This may be consulted at three occasions only:

(1) in the beginning, during the initial portfolio constitution, for all assets (2) when an asset is bought or sold (once the decision is taken), for the asset concerned; and (3) when a player asks for an evaluation of his CAPITAL (see §2.14), for all the assets belonging to that player.

All players may read the back of the asset card(s) at these occasions.

Hence, players must try to memorize the current value rules for the various assets in the game. An understanding of the economic thinking behind these rules will help in their effort. Once the rules are assimilated, players strive to take advantage of them by buying when current value is down and selling when it is up.

2.7 Otherwise, rules for dividend distribution and purchase or sale of stocks remain unchanged. In particular, speculation on the outcome of FACTS & FIGURES cards is done just like in the Advanced Game, with the only difference that stocks are traded at current instead of face value.

2.8 DISTRESS SALES of all assets are made at half their CURRENT VALUE.

2.9 The STOCK BUYBACK space has a special significance in the Professional Game, as it allows players to sell their holdings in one type of stock (or mutual fund) to the Bank for face value. It thus affords a way to avoid a price decline linked to an unfavorable evolution of KEY ECONOMIC INDICATORS. Remember, however, that the ASSET card is turned around and CURRENT VALUE determined only after the selling decision is taken.

2.10 The rules for CURRENT VALUE of real estate, gold and foreign exchange are identical to those for stocks and mutual funds.

2.11 A special problem arises in connection with those assets that are themselves KEY INDICATORS, namely D-Mark and yen notes. The rule for these assets is that their CURRENT VALUE always equals face value, regardless of what happens to the relevant key indicator. To understand why this must be so, consider a D-mark government bond with a U.S. $10,000 face value. Suppose that a FACTS & FIGURES card indicates a 0.10 DM/$ appreciation in the German currency. The ECONOMIST strikes out 2.00 DM/$ and writes instead 1.90 DM/$ on the CONTROL PANEL. The FACTS & FIGURES card would also indicate that DM holdings go up by $500. According to the rules, a player holding DM thus collects $500 from the Bank per $10,000 note he owns. If the current value of his asset now would also rise in line with the relevant KEY INDICATOR, the investor would be rewarded twice for the same event. As this would be unrealistic, the rule stipulates that current value of D-Mark and yen notes is not affected by changes in the corresponding key economic indicators.

2.12 For OPTIONS, the rule is that the strike price is the CURRENT VALUE before the Market Response, while the offsetting transaction takes place at current value after the Market Response, i.e., including possible price movements resulting from the present FACTS & FIGURES card (whether direct or via changes in key indicators).

In the examples for options investment given in the Advanced Game Rules, we have assumed that the CURRENT VALUE of the shares equals $10,000, i.e., face value; in fact, this need not be the case. Unless the current value is changed by the given FACTS & FIGURES card however, this makes no difference in practice. To illustrate, take Player Three who bought 20 call options in the example given in the Advanced Game Rules. The share price went up by $2,500. Suppose the current value of the shares is $8,000 instead of $10,000. The 20 options entitle him to 20 shares for $8,000 each. Usually, he will immediately re-sell those 20 shares, for $8,000+$2,5000=$10,500 per share; he then earns $2,500 per share (minus the $500 options premium), regardless of what the current value actually is. He will nevertheless turn the mutual fund asset card to make sure its current value has not been altered by the present FACTS & FIGURES card (through a changing a KEY ECONOMIC INDICATOR).

2.13 In the ASSET BIDDING procedure, CURRENT VALUE is not determined, as it is not relevant to the transaction.

2.14 The game ends when a player owns at least $500,000 and asks the Broker for an evaluation of his CAPITAL; this may be done anytime during the game. The Broker then calculates and adds up the current value of all the assets belonging to the player in question. If the total value is $500,000 or more, the player has won the game and quits. If however, it is less than $500,000, the player must pay a $20,000 penalty—thus, a player should not ask for a CAPITAL EVALUATION unless he feels reasonably sure that he has reached the $500,000 mark.

Other embodiments are within the following claims, for example possible extensions over the Advanced Game include:

(1) additional ASSET cards, e.g. option cards with various strike prices, expire dates, etc.; or new stocks, commodities, convertible bonds, etc. New FACTS & FIGURES cards to go along with the new types of assets may be required;

(2) transactions between players are allowed, in particular WRITING (and auctioning) of options. The rules are similar to those for the standard options transactions with the Bank, but proposals are made by the drawing player before he turns the FACTS & FIGURES card. Bargaining then takes place;

(3) players may be allowed to BORROW from the Bank; or (4) introduction of standard FUTURES contracts similar to the Advanced Game options.

What is claimed is:

1. A method of playing a board game simulating situations of economics and finance using a board game comprising (1) a game board defining a multiplicity of contiguous marked space playing positions defining a continuous closed track extending about said game board, space playing positions bearing indicia of instructions for play of the game; (2) a plurality of playing pieces each representing a player; (3) means for determining how many space playing positions to move each playing piece about the track independent of any predetermined economic cycle; (4) simulated money or different denominations for use in play of the game; (5) means for indicating ownership of assets for purchase and sale by players using said simulated money; and (6) means for indicating a microeconomic or macroeconomic occurrence having a potential economic effect on the game value of an asset held by a player, and means for subsequently revealing the economic effects of said occurrence, after one or more players had an opportunity to act upon an expected economic effect of said occurrence having potential economic effect and including one or more second spaces permitting a player to buy and/or sell said means for indicating ownership of an asset;

said method comprising:

(a) each player, in turn, constituting an initial portfolio of assets by exchange of simulated money for means indicating ownership of assets;

(b) each player, in turn, actuating said means for determining how many space playing positions to move his playing piece, and advancing his playing piece the determined number of positions along the closed track about the game board;

(c) each said player on landing his playing piece upon a said first space consults said means for indicating an occurrence having potential economic effect, acts as he considers appropriate to maximize the total of his simulated money and asset value by buying or selling assets or by taking no action, and thereafter consults said means for subsequently revealing the economic effect of the occurrence, players thereafter receiving or paying simulated money on the basis of said economic effect of the occurrence on the assets in their respective portfolios;

(d) each said player on landing his playing piece on a said second space buys and/or sells assets or takes no action as he desires; and (e) play of the game continues with each player acting in turn until the value of all assets and simulated money held by one player exceeds a predetermined total and that player is declared the winner.

2. The method of claim 1 comprising providing assets which comprise liquid and illiquid assets, and permitting payments by a player in simulated money or liquid assets.

3. the method of claim 1 comprising providing assets which comprise high risk and low risk assets.

4. The method of claim 1 comprising permitting acquisition and sale of assets between a player and a game bank.

5. The method of claim 1 comprising permitting acquisition and sale of assets between players.

6. The method of claim 1 wherein before consulting said means for subsequently revealing the economic effect of an event, permitting a player to purchase options one or more assets.

7. The method of claim 1 comprising providing means for subsequently revealing the economic effect of any event including indicia of changes in key economic indicators, and causing the value of assets held by players to fluctuate during play of the game in response to these key economic indicators.

* * * * *

UNITED STATES PATENT AND TRADEMARK OFFICE

CERTIFICATE OF CORRECTION

PATENT NO. : 4,856,788

DATED : August 15, 1989

INVENTOR(S) : Mario Fischel

It is certified that error appears in the above-identified patent and that said Letters Patent is hereby corrected as shown below:

Col. 1, line 59, "assests" should be --assets--.

Col. 2, line 19, "space" should be --spaces--.

Col. 2, line 22, "deal" should be --legal--.

Col. 4, line 4, a colon ":" should be inserted after "beginning".

Col. 5, line 4, "managements" should be --management--.

Col. 5, line 41, "brins" should be --brings--.

Col. 7, line 48, "FIGS." should be --FIGURES--.

Col. 8, line 9, "same" should be --game--.

Col. 14, line 42, "loner" should be --longer--.

Col. 15, line 3, "old" should be --gold--.

Col. 16, line 9, "$2,5000" should be --$2,500--.

Col. 17, line 16, "ar" should be --are--.

Col. 21, line 50, after "change" insert --in--.

Col. 22, line 27, "or" should be --of--.

UNITED STATES PATENT AND TRADEMARK OFFICE

CERTIFICATE OF CORRECTION

PATENT NO. : 4,856,788

DATED : August 15, 1989

INVENTOR(S) : Mario Fischel

It is certified that error appears in the above-identified patent and that said Letters Patent is hereby corrected as shown below:

Col. 23, line 5, "the" should be --The--.

Col. 24, line 7, "any" should be --an--.

Signed and Sealed this

First Day of January, 1991

*Attest:*

HARRY F. MANBECK, JR.

*Attesting Officer*

*Commissioner of Patents and Trademarks*